US009802435B2

(12) United States Patent
Morita

(10) Patent No.: US 9,802,435 B2
(45) Date of Patent: Oct. 31, 2017

(54) IMAGE FORMING APPARATUS AND COMPUTER-READABLE RECORDING MEDIUM STORING PROGRAM

(71) Applicant: Konica Minolta, Inc., Chiyoda-ku, Tokyo (JP)

(72) Inventor: Keisuke Morita, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/238,794

(22) Filed: Aug. 17, 2016

(65) Prior Publication Data

US 2017/0066272 A1 Mar. 9, 2017

(30) Foreign Application Priority Data

Sep. 3, 2015 (JP) ..... 2015-173608

(51) Int. Cl.

| | |
|---|---|
| ***G03G 15/00*** | (2006.01) |
| ***B42C 19/02*** | (2006.01) |
| ***B42C 1/12*** | (2006.01) |
| ***B42C 3/00*** | (2006.01) |
| ***B42C 9/00*** | (2006.01) |
| ***B65H 39/00*** | (2006.01) |

(Continued)

(52) U.S. Cl.

CPC ..... *B42C 19/02* (2013.01); *B42C 1/12* (2013.01); *B42C 3/00* (2013.01); *B42C 5/04* (2013.01); *B42C 9/0006* (2013.01); *B65H 39/00* (2013.01); *B65H 45/30* (2013.01); *G03G 15/6544* (2013.01); *B65H 2301/45* (2013.01); *B65H 2801/48* (2013.01); *G03G 2215/00586* (2013.01); *G03G 2215/00822* (2013.01); *G03G 2215/00877* (2013.01); *G03G 2215/00936* (2013.01)

(58) Field of Classification Search

CPC ..... B42C 19/02
USPC ..... 399/408
See application file for complete search history.

(56) References Cited

U.S. PATENT DOCUMENTS

| | | | | |
|---|---|---|---|---|
| 6,213,456 | B1 * | 4/2001 | Hirano | G03G 15/6541 270/58.07 |
| 2002/0119029 | A1 * | 8/2002 | Cobene | B42C 11/04 412/4 |

(Continued)

FOREIGN PATENT DOCUMENTS

| | | |
|---|---|---|
| JP | 2014-124836 A | 7/2014 |
| JP | 2015-3436 A | 1/2015 |

*Primary Examiner* — Anthony Nguyen
(74) *Attorney, Agent, or Firm* — Buchanan Ingersoll & Rooney PC

(57) ABSTRACT

A control portion of an image forming apparatus creates an image list for performing the perfect-binding imposition of the images of the pages on the sheets so that the scores formed on the sheets are on the external surface of the center-folded sheets, for the sheets each having a size twice the size specified as each of the sheets on which the images of the book body are to be formed, when a book-body stacking portion accommodates the sheets center-folded by a folding portion along scores formed for every sheet from a predetermined direction by a scoring portion for each of the sheets having the images formed thereon by the image forming portion, and a bookbinding portion uses a glue-on cover to perform case binding of a bundle of the sheets glued to the side of the spine.

12 Claims, 9 Drawing Sheets

(51) Int. Cl.
*B65H 45/30* (2006.01)
*B42C 5/04* (2006.01)

(56) References Cited

U.S. PATENT DOCUMENTS

2004/0245694 A1* 12/2004 Hoarau ..... B42C 5/04
270/52.17
2005/0116461 A1* 6/2005 Katz ..... B42C 9/0081
281/21.1
2008/0018944 A1* 1/2008 Morita ..... H04N 1/00639
358/296
2008/0252062 A1* 10/2008 Kelley ..... B65H 45/30
281/21.1
2009/0035093 A1* 2/2009 Takagi ..... G03G 15/6544
412/11
2015/0239704 A1* 8/2015 Ooba ..... G03G 15/6582
493/405

* cited by examiner

FIG. 4A
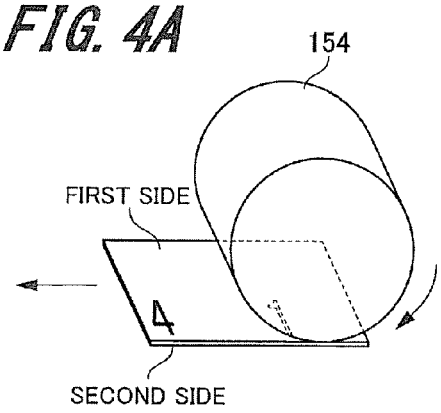
FIG. 4B
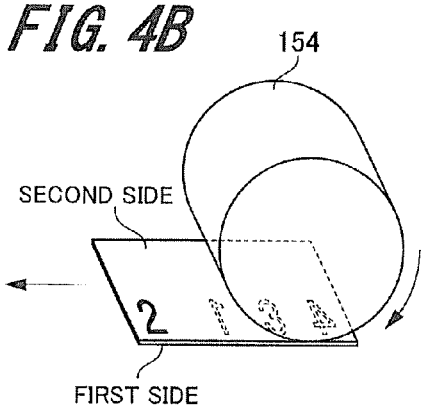
FIG. 5A
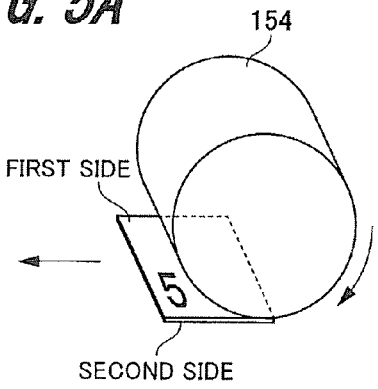
FIG. 5B
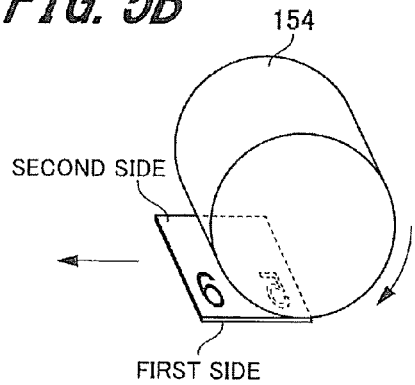
FIG. 6
| SCORING DIRECTION | UNDER-DRUM IMAGES | | REMARK |
|---|---|---|---|
| | FIRST SIDE | SECOND SIDE | |
| LEFT DIRECTION | 4 1 | 2 3 | |
| RIGHT DIRECTION | 2 3 | 4 1 | REVERSING REQUIRED BY PRE-FOLDING REVERSING MECHANISM FOR FOLDING MECHANISM OF FIG. 4 |

FIG. 11A

| | FIRST SHEET | SECOND SHEET | THIRD SHEET |
|---|---|---|---|
| FIRST SIDE | 4 1 | BLANK 5 | 10 7 |
| SECOND SIDE | 2 3 | 6 BLANK | 8 9 |

FIG. 11B

| | FIRST SHEET | SECOND SHEET | THIRD SHEET | FOURTH SHEET |
|---|---|---|---|---|
| FIRST SIDE | 4 1 | 5 | 6 | 10 7 |
| SECOND SIDE | 2 3 | | | 8 9 |

FIG. 11C

| | FIRST SHEET | SECOND SHEET | THIRD SHEET | FOURTH SHEET |
|---|---|---|---|---|
| FIRST SIDE | 4 1 | 5 | 6 | BLANK 8 |
| SECOND SIDE | 2 3 | | 7 | 9 10 |

FIG. 12A

| | FIRST SHEET | SECOND SHEET | THIRD SHEET | FOURTH SHEET | FIFTH SHEET |
|---|---|---|---|---|---|
| FIRST SIDE | 16 1 | 5 2 | 9 6 | 13 10 | BLANK 14 |
| SECOND SIDE | | 3 4 | 7 8 | 11 12 | 15 BLANK |

FIG. 12B

| | FIRST SHEET | SECOND SHEET | THIRD SHEET | FOURTH SHEET |
|---|---|---|---|---|
| FIRST SIDE | 15 16 1 | 6 3 | 10 7 | BLANK 11 |
| SECOND SIDE | 2 14 | 4 5 | 8 9 | 12 13 |

IMAGE FORMING APPARATUS AND COMPUTER-READABLE RECORDING MEDIUM STORING PROGRAM

BACKGROUND OF THE INVENTION

Field of the Invention

The present invention relates to, for example, an image forming apparatus applied in a case of performing case binding, and a computer-readable recording medium storing a program.

Description of the Related Art

An image forming system is configured by connecting various sheet processing devices to an image forming apparatus. For example, processing of case binding is possible by attaching a glue-on cover to the back of a collated sheet bundle of a book body, after having applied glue with a predetermined thickness thereon. When performing case binding, a sheet obtained by integrating the back cover, spine, and front cover is used as the glue-on cover, and a score is formed on a portion to be the corner of the spine of the glue-on cover by using a scoring device referred to as a creaser.

With regard to case binding, techniques described in the following patent literatures are known. Patent Literature 1 discloses a technique which forms a score to the edge of a region of the cover to which the sheet bundle is caused to adhere, bends the cover along the score, and performs bookbinding in a manner of covering the sheet bundle with the cover.

Patent Literature 2 discloses a technique which makes it possible to uniformly apply glue on the back of the sheet bundle by forming the tip side of the doctor blade in a curved manner with the center protruding and thus by reducing the amount of glue adhering to the central part of the sheet bundle.

RELATED ART DOCUMENT

Patent Document

Patent Literature 1: Japanese Patent Laid-Open No. 2015-3436

Patent Literature 2: Japanese Patent Laid-Open No. 2014-124836

DISCLOSURE OF THE INVENTION

Problems to be Solved by the Invention

Incidentally, even if a glue-on cover is attached with glue applied to the back of the sheet bundle of the book body, when case binding is performed using a large amount of sheets, there may be a case where the glue applied to the back of the sheet bundle becomes thin or runs out. In such a case, a part of the sheet bundle of the book body may peel off from the glue-on cover.

In addition, it has been difficult for the glue to penetrate into the back of the sheet bundle even if case binding is performed using the techniques disclosed in Patent Literatures 1 and 2 and there still remains a possibility of the sheet peeling off from the case-bound sheet bundle.

The present invention has been made in view of these circumstances, and an object of the present invention is to prevent sheets from peeling off from a case-bound sheet bundle.

SUMMARY OF THE INVENTION

In order to realize at least one of the aforementioned objects, an image forming apparatus reflecting an aspect of the present invention includes an image forming portion and a control portion.

The image forming portion forms images on sheets in accordance with an image list defining order of the images of pages to be formed on the sheets of a case-bound booklet so that the sheets are bound in order of the pages, and imposing the images of a plurality of pages on the sheets.

The control portion creates the image list for performing the perfect-binding imposition of the images of the pages on the sheets so that the scores formed on the sheets are on the external surface of the center-folded sheets, for the sheets each having a size twice the size specified as each of the sheets on which the images of the book body are to be formed, in a case where a book-body stacking portion accommodates the sheets center-folded by a folding portion along scores formed for every sheet from a predetermined direction by a scoring portion for each of the sheets having the images formed thereon by the image forming portion, and a bookbinding portion uses a glue-on cover to thereby perform case binding of a bundle of the sheets glued to the side of the spine.

Note that the aforementioned image forming apparatus is an aspect of the present invention, and a program reflecting an aspect of the present invention stored in a computer-readable recording medium also has a configuration similar to the image forming apparatus reflecting an aspect of the present invention.

BRIEF DESCRIPTION OF THE DRAWINGS

FIG. 4A is an explanatory diagram illustrating an example in which a toner image formed on a photoreceptor drum is transferred to a first side of a sheet.

FIG. 4B is an explanatory diagram illustrating an example in which a toner image formed on the photoreceptor drum is transferred to a second side of the reversed sheet.

FIG. 5A is an explanatory diagram illustrating an example in which a toner image formed on a photoreceptor drum is transferred to a first side of a sheet.

FIG. 5B is an explanatory diagram illustrating an example in which a toner image formed on the photoreceptor drum is transferred to a second side of the reversed sheet.

FIG. 6 is an explanatory diagram illustrating a correspondence example of scoring directions and under-drum images according to an embodiment of the present invention.

FIG. 11A is an explanatory diagram illustrating an imposition layout example in which simplex printing is designated for pages 5 and 6.

FIG. 11B is an explanatory diagram illustrating an imposition layout example in which simplex printing is designated only for an image of page 5.

FIG. 11C is an explanatory diagram illustrating an imposition layout example in which simplex printing is designated for an image of page 5, and duplex printing is designated for images of pages 6 and 7.

FIG. 12A is an explanatory diagram illustrating an imposition layout example in which simplex printing is designated for images arranged by a "2-in-1" setting on a glue-on cover.

FIG. 12B is an explanatory diagram illustrating an imposition layout example in which duplex printing is designated for images arranged by a "3-in-1" setting on a glue-on cover.

DESCRIPTION OF THE PREFERRED EMBODIMENTS

Figure 1:
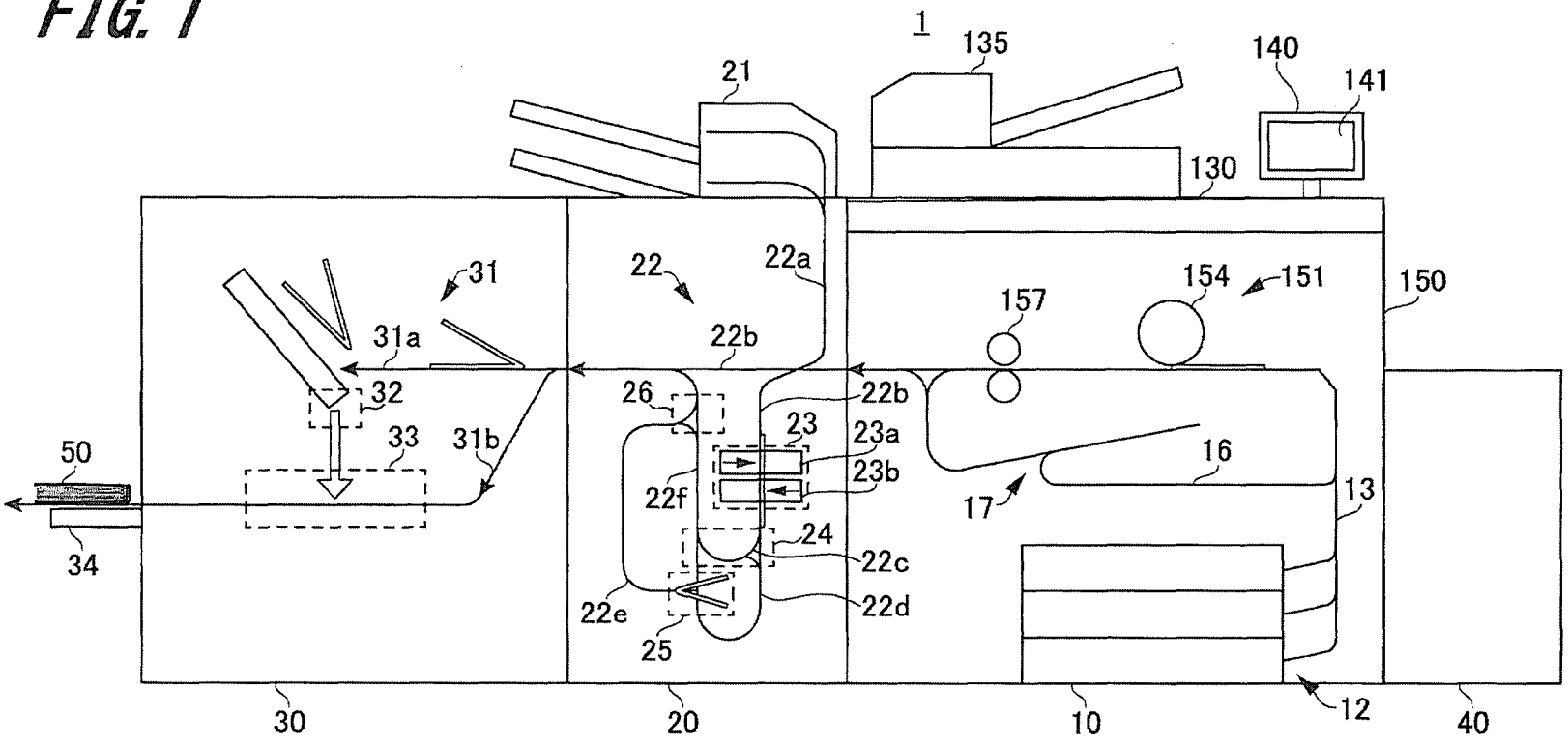
FIG. 1 is a block diagram illustrating a configuration example of an image forming system according to an embodiment of the present invention.

Hereinafter, an image forming apparatus according to an embodiment of the present invention will be described by referring to the attached drawings. In the description and the drawings, the same reference numerals are attached to constituent elements having substantially the same functions or configurations, and thus duplicated explanation is omitted.

FIG. 1 illustrates a schematic configuration example of an image forming system 1.

The image forming system 1 has a large-capacity sheet feed unit 40 configured to feed a large amount of sheets connected to the former stage of an image forming apparatus 10, and has a relay device 20 and a post-processing device 30 connected in series to the latter stage of the image forming apparatus 10. In the image forming system 1, sheets be can conveyed among respective devices and also the respective devices are capable of communicating with each other. In the present embodiment, the relay device 20 and the post-processing device 30 perform in-line processing. Note that the relay device 20 and the post-processing device 30 may be built in the image forming apparatus 10.

Note that the connection configuration of the image forming apparatus of the present invention is not limited to the one described above, and an image forming system may be constituted by only the image forming apparatus.

The image forming apparatus 10 is provided with an auto document feeder (ADF) 135 at the upper side thereof, whereby image reading of a document fed by the auto document feeder 135 may be performed by a scanner portion 130. Note that the document may also be read on a platen glass 137 (see FIG. 2 described below).

In addition, an LCD 141 of an operation portion 140 is installed at a position where the platen glass is not located on the upper side of the image forming apparatus 10 or the relay device 20. The LCD 141 is constituted of a touch panel, and allows operation by an operator and display of information. The LCD 141 functions as both an operation portion and a display portion. Note that it is also possible to constitute the operation portion by a mouse, a tablet or the like, separately from the display portion. In addition, the LCD 141 may be movable.

A plurality of sheet feed trays 12 (three stages in the drawing) is arranged at the lower side of the image forming apparatus 10. The image forming apparatus 10 is provided with a conveyance path 13 for conveying sheets fed from any of the sheet feed trays 12. A printer portion 150 provided in the image forming apparatus 10 is constituted of an image forming portion 151, the sheet feed trays 12, the conveyance path 13, a reverse conveyance path 16, a reversing portion 17, or the like. A fixing device 157 is arranged on the conveyance path 13 on the downstream side of a photoreceptor drum 154.

The conveyance path 13 extends on the downstream side of the fixing device 157 to be connected to a conveyance path 22 of the relay device 20. Furthermore, the reverse conveyance path 16 which branches on the downstream side of the fixing device 157 and joins the conveyance path 13 on the upstream side of the printer portion 150 is connected to the conveyance path 13. The reverse conveyance path 16 is provided with the reversing portion 17 which reverses sheets. A sheet reversed in the reversing portion 17 can be returned through the reverse conveyance path 16 to the conveyance path 13 on the upstream side of the printer portion 150, or a sheet reversed by switching paths can also be returned to the conveyance path 13 on the downstream side of the fixing device 157 and be directly conveyed to the relay device 20.

The processing of forming an image on a sheet by the image forming portion 151 will be described later. A sheet having an image formed thereon by the printer portion 150 is conveyed to the fixing device 157. The fixing device 157 fixes, as an output image, a toner image transferred to the front side of the sheet by heating the conveyed sheet. The sheet subjected to the fixing processing is either conveyed to the relay device 20 through the conveyance path 13 or front/back reversed by the reversing portion 17 through the reverse conveyance path 16, and subsequently returned to the conveyance path 13 on the upstream side of the printer portion 150. The front/back reversed sheet is subjected to image formation on the back side thereof by the printer portion 150.

The relay device 20 includes a PI (Post Inserter) portion 21 and the conveyance path 22.

The PI portion 21 inserts a sheet (e.g., a glue-on cover, sheets of book body) having an image formed thereon by another image forming apparatus 10 into the conveyance path 22, and is used as an example of a sheet insertion portion.

The conveyance path 22 is connected to the conveyance path 13, and a conveyance path 31 of the post-processing device 30 on the latter stage. The conveyance path 22 collectively refers to the conveyance paths 22*a* to 22*f* as will be described below. In addition, the relay device 20 has a scoring portion 23, a pre-folding reversing portion 24, a folding portion 25, and a pre-conveyance reversing portion 26.

When it is not necessary to reverse the sheet (mainly a glue-on cover) inserted from the PI portion 21 or, when it is not necessary to perform scoring on the sheet, the sheet conveyed from the conveyance path 22*a* or the conveyance path 22*b* is conveyed to the post-processing device 30 without passing through the scoring portion 23 and the folding portion 25. However, when the sheet inserted from the PI portion 21 is to be reversed, the sheet conveyed from the conveyance path 22*a* is reversed by the pre-folding reversing portion 24 and then conveyed to the post-processing device 30 through the conveyance path 22*f*.

The scoring portion 23 is provided in the conveyance path 22*b*, and is capable of forming a score from a predetermined direction for every sheet on one side of each sheet having an image formed thereon by the image forming portion 151. The scoring portion 23 includes a first scoring portion 23*a* and a second scoring portion 23*b*, and is also referred to as a creaser. The scoring portion 23 performs scoring from either the left or right direction on a sheet having a perfect-bound image formed thereon, or on a position serving as a folded line of a glue-on cover.

Here, the first scoring portion 23*a* has a scoring knife not illustrated and a scoring platform having a concave portion. After a sheet conveyed through the conveyance path 22 to a predetermined position has temporarily stopped, the scoring knife extends toward the scoring platform and thus a score is formed on the sheet sandwiched between the scoring knife and the concave portion of the scoring platform, from the far side toward the near side of the drawing. The score is obtained by performing scoring perpendicularly to the left side of the sheet along the arrow pointing from the left to the right. In the scoring processing, the sheet keeps a planar state as a whole, and a score having a substantially semi-circular cross-section is formed on the sheet.

The second scoring portion 23*b* has a mechanism similar to that of the first scoring portion 23*a*, and performs scoring perpendicularly to the right side of the sheet along the arrow pointing from the right to the left. The second scoring portion 23*b* can also form a score having a substantially semi-circular cross-section on the planar sheet.

The sheet having passed through the scoring portion 23 as described above is subjected to scoring from either the right or left direction by either the first scoring portion 23*a* or the second scoring portion 23*b*. Then, the scoring portion 23 can form one or more scores on a desired position on the sheet. The sheet subjected to scoring is conveyed to the pre-folding reversing portion 24. In the following description, the side of the sheet subjected to scoring is referred to as a "scored side".

The pre-folding reversing portion 24 reverses a sheet in accordance with the scored side thereof. For example, the pre-folding reversing portion 24 reverses a sheet by conveying the sheet through the conveyance path 22*c* and the conveyance path 22*d* in this order, and conveys the reversed sheet to the folding portion 25. When it is not necessary to reverse the sheet, the pre-folding reversing portion 24 conveys from the conveyance path 22*d* to the folding portion 25, without reversing the sheet which has been conveyed from the scoring portion 23.

The folding portion 25 folds the center of the sheet along the score formed by the scoring portion 23*b*, with the scored side facing outwards. The center-folded sheet is conveyed through the conveyance path 22*e*. The direction of the center-folding of the sheet by the folding portion 25 is one-way, and the sheet is not center-folded, with the scored side facing inwards. A sheet requiring center-folding is center-folded by the folding portion 25, with the scored side facing outwards, and thus requires a reversing processing by the pre-folding reversing portion 24. In addition, the sheet is center-folded, with the scored side facing outwards, and thus the printing order of images to be formed on the sheet by the printer portion 150 is specified by a case binding image list (an example of list of image) described below. Note that, when center-folding by the folding portion 25 is unnecessary, the sheet subjected to scoring is conveyed from the conveyance path 22*d* to the conveyance path 22*b* through the conveyance path 22*f*.

The pre-conveyance reversing portion 26 reverses, in accordance with the orientation of sheets of a book body to be accommodated in a book-body stacking portion 32 provided in the post-processing device 30, a center-folded sheet to be conveyed to the post-processing device 30. Note that, in a case where the sheet is a glue-on cover and already reversed by the pre-folding reversing portion 24, the sheet is conveyed to the post-processing device 30 without being reversed by the pre-conveyance reversing portion 26.

The post-processing device 301 includes the conveyance path 31 connected to the conveyance path 22, and a post-processing portion for performing case binding as post-processing. The post-processing portion includes a book-body stacking portion 32, a case binding portion 33, and an ejection portion 34. The conveyance path 31 collectively refers to the conveyance path 31*a* for conveying sheets of a book body to the book-body stacking portion 32, and the conveyance path 31*b* for conveying a glue-on cover to the case binding portion 33.

The book-body stacking portion 32 accommodates, for each one of booklets 50 bound by the case binding portion 33, sheets of a book body conveyed from the conveyance path 31*a*. Although the book-body stacking portion 32 accommodates sheets of a book body so that the part to be glued on the spine region of a glue-on cover faces downward, sheets of a book body can also be accommodated so that the part of interest faces upward. In such a case, the sheets of the book body are required to be reversed by the pre-conveyance reversing portion 26. In addition, the book-body stacking portion 32 then supplies the sheet bundle of the accommodated book body to the case binding portion 33.

The case binding portion 33 bends the glue-on cover conveyed to the conveyance path 31*b* along two scores formed with the width of the spine based on the thickness of the sheet bundle. In addition, the case binding portion 33 then performs case binding by wrapping, with the glue-on cover, the sheet bundle of the book body glued on the spine side.

The ejection portion 34 ejects the case-bound booklet 50 to the outside of the post-processing device 30.

Note that, in a case where execution of post-processing has not been set, the post-processing device 30 ejects the sheets from the ejection portion 34 without performing post-processing. In addition, the post-processing device 30 may include a mechanism that performs predetermined post-processing such as punching, saddle stitching stapling, in addition to case binding.

Figure 2:
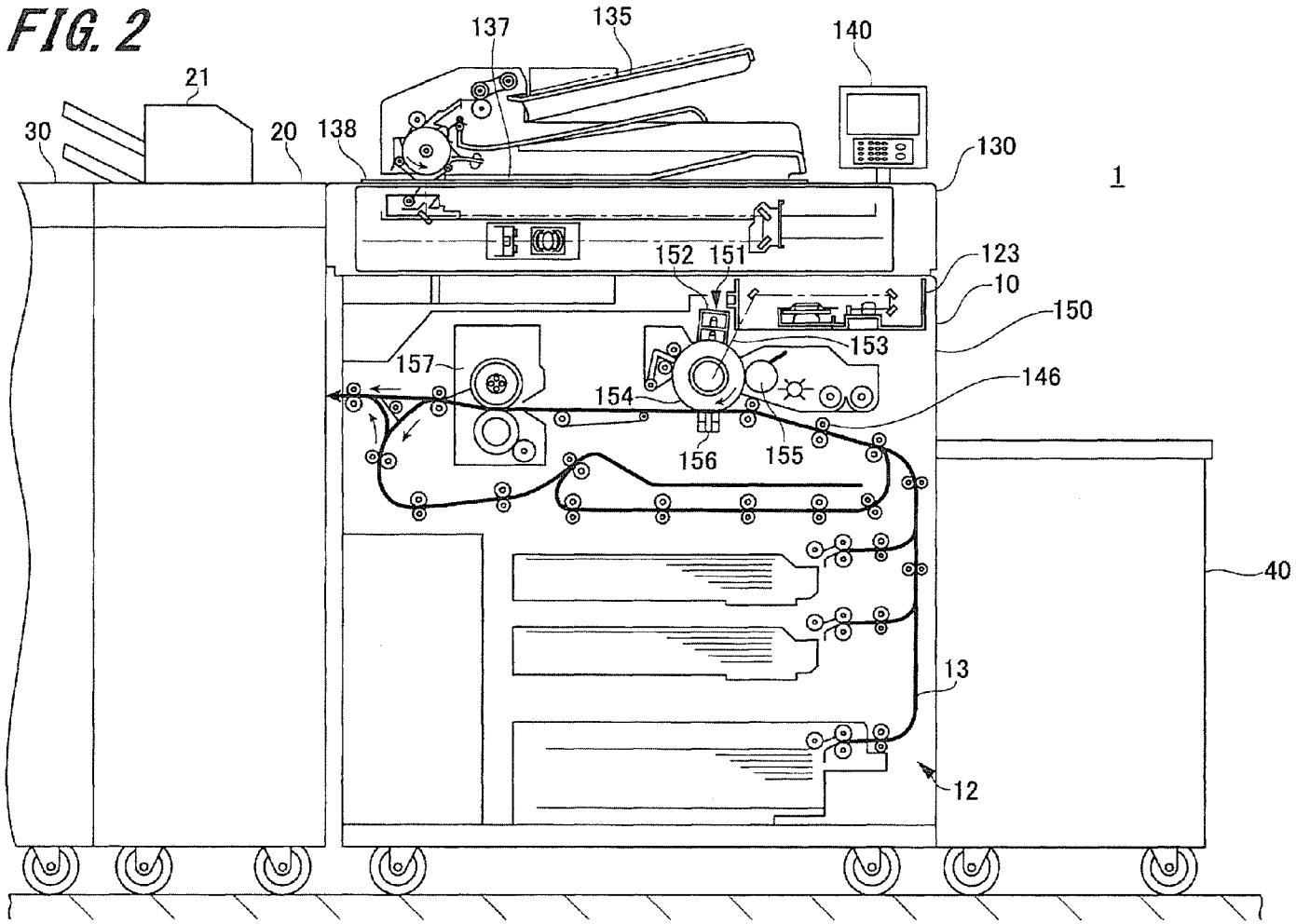
FIG. 2 is a central cross-sectional view of the image forming apparatus according to an embodiment of the present invention.

FIG. 2 is a central cross-sectional view of the image forming apparatus 10.

The image forming apparatus 10 is provided, on the upper side thereof, with a scanner portion 130 including a CCD 131 (see FIG. 3) and the auto document feeder 135, and is capable of image reading of documents through the platen glass 137 or an ADF document-reading slit glass 138.

An image reading portion is constituted of the scanner portion 130, the auto document feeder 135, the platen glass 137, the ADF document-reading slit glass 138, or the like.

The image forming apparatus 10 is provided with the conveyance path 13 for conveying sheet fed from any of the sheet feed trays 12, a feed roller 146, or the like. The image forming portion 151 constituted of an electric charger 152, an LD 153, the photoreceptor drum 154, a developing device 155, a transfer portion 156, a fixing device 157, or the like is provided in the middle of the conveyance path 13 in the image forming apparatus 10. In addition, the large-capacity sheet feed unit 40 is provided with a conveyance path (not illustrated) for conveying fed sheets and introducing the fed sheets into the image forming apparatus 10.

In the image forming portion 151, the electric charger 152, the developing device 155, and the transfer portion 156 are provided around the photoreceptor drum 154. The electric charger 152 uniformly charges the surface of the photoreceptor drum 154 before writing an image. The LD 153 forms an electrostatic latent image on the photoreceptor drum 154 by irradiating, with semiconductor laser, the photoreceptor drum 154 having a surface uniformly charged. The developing device 155 develops, with toner material, the electrostatic latent image formed on the photoreceptor drum 154 by the LD 153. A toner image is formed on the photoreceptor drum 154 by the developing processing. The transfer portion 156 transfers the toner image on the photoreceptor drum 154 to a sheet which has been conveyed from the sheet feed trays 12 and the large-capacity sheet feed unit 40. The sheet having the toner image transferred thereto is separated from the photoreceptor drum 154 and is conveyed to the fixing device 157. The toner material remaining on the photoreceptor drum 154 is removed by a cleaning portion.

The fixing device 157 fixes the toner image transferred on the front side of the sheet by heating the conveyed sheet. In the case of simplex printing, the sheet subjected to the fixing processing is directly conveyed to the relay device 20 located at the side of the image forming apparatus 10. In the case of duplex printing, the sheet after fixing is switched back, whereby a predetermined image is transferred on the back side of the sheet by the image forming portion 151. Then, the sheet having an image formed on both sides thereof is conveyed to the relay device 20 after fixing.

The image forming system 1 is constituted of the image forming apparatus 10, the relay device 20, the post-processing device 30, and large-capacity sheet feed unit 40. However, the devices constituting the image forming system as the present invention are not particularly limited in terms of numbers or types except for the image forming apparatus, and may include a plurality of post-processing devices, or additionally, various external devices such as a stack device can be connected thereto.

Next, a functional configuration of the image forming system 1 will be described.

Figure 3:
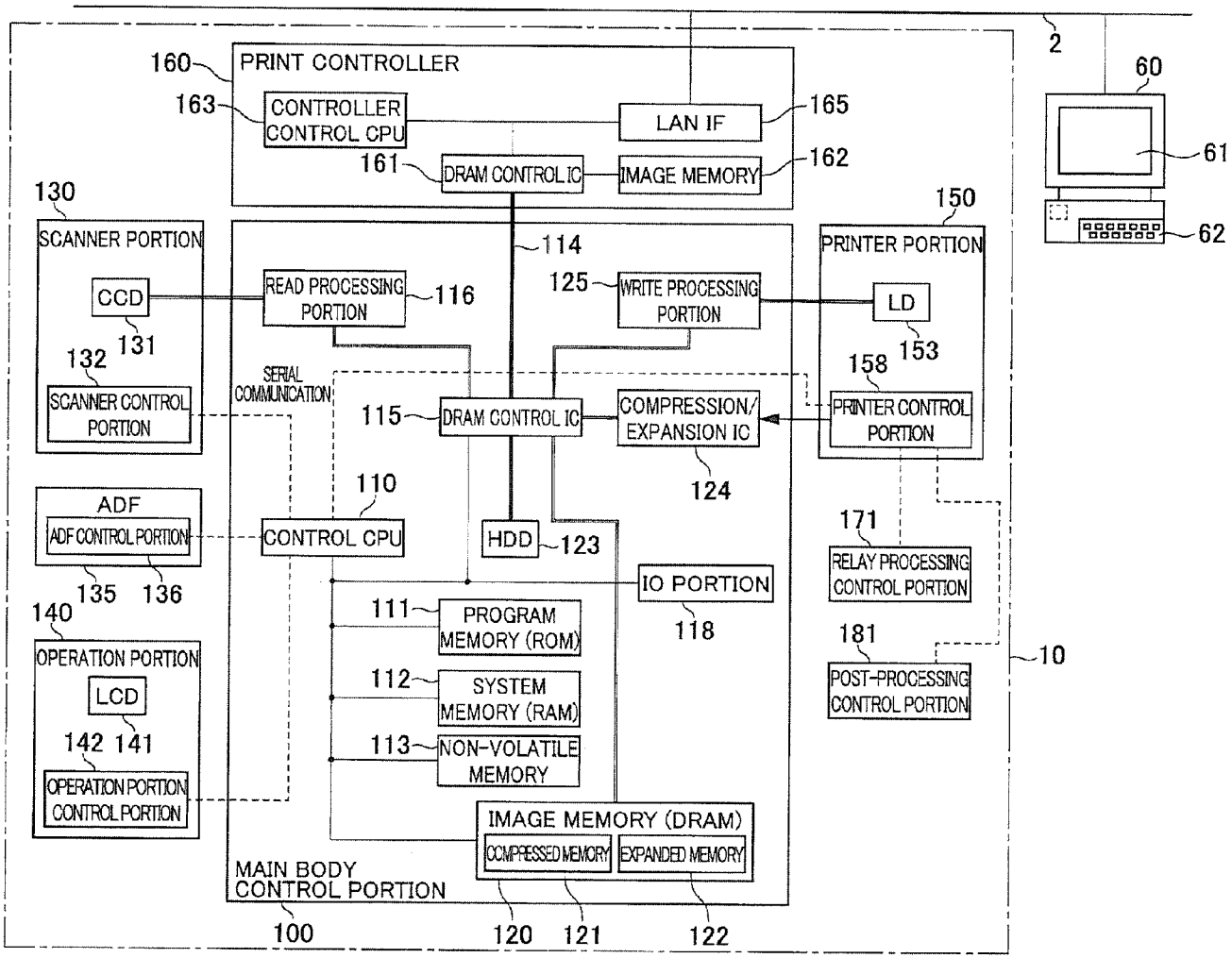
FIG. 3 is a block diagram illustrating a functional configuration example of the image forming system according to an embodiment of the present invention.

FIG. 3 is a block diagram illustrating a functional configuration example of the image forming system 1.

The image forming device 10 includes a main body control portion 100, the scanner portion 130, operation portion 140, and the printer portion 150. Furthermore, the image forming apparatus 10 includes a print controller 160 which processes image data input from an external device 60 such as a terminal PC through a LAN 2, or which allows the image data obtained at the scanner portion 130 to be transferred to the external device 60 through the LAN 2.

The main body control portion 100 has a PCI bus 114 connected to the print controller 160, and a DRAM control IC 115 is connected to the PCI bus 114. An image memory 120 is connected to the DRAM control IC 115. For example, a DRAM (Dynamic Random Access Memory) is used as the image memory 120. The image memory 120 has a compressed memory 121 for storing compressed image data and an expanded memory 122 for temporarily storing, before image formation, decompressed image data to be printed.

Furthermore, an HDD (Hard Disk Drive) 123 is connected to the PCI bus 114; and image data acquired by the scanner portion 130, image data generated by the external device 60 or the like connected to the print controller 160, or the like are stored in the HDD 123.

Image data acquired by the print controller 160 or image data stored in the HDD 123 is transmitted to the DRAM control IC 115 through the PCI bus 114 along with a print operation.

Moreover, the main body control portion 100 includes a control CPU (Central Processing Unit) 110. The control CPU 110 is used as an example of a computer which controls the operation of respective portions in the image forming apparatus 10. The DRAM control IC 115 is connected to the control CPU 110.

In addition, a program memory 111 constituted by a ROM (Read Only Memory) and storing programs or the like for operating the control CPU 110, a system memory 112 constituted by a RAM (Random Access Memory) and used as a work area or the like, and a non-volatile memory 113 constituted by a flash memory or the like are connected to the control CPU 110. The non-volatile memory 113 has readably stored therein: initial print setting information of the image forming apparatus 10; device setting information such as process control parameters; initial data of output settings; post-processing settings; settings of post-processing prohibition; settings such that a predetermined post-processing output is obtained by addition of an offline work; or the like.

Note that the post-processing prohibition refers to a state where, although the in-line relay device 20 and the post-processing device 30 has a function of obtaining a desired output, the function cannot be used by a combination with other functions, settings or the like.

The control CPU 110 is capable of reading non-volatile data in the non-volatile memory 113, and writing desired data to the non-volatile memory 113.

The control CPU 110 operates by a program stored in the program memory 111, and controls the operation of respective portions of the image forming apparatus 10 in accordance with the device setting information, print setting information, output settings and the like which have been read from the non-volatile memory 113.

The control CPU 110 constitutes the control portion together with the program memory 111, the system memory 112, the non-volatile memory the 113 or the like and is capable of controlling execution and cancellation of jobs, or the like.

The program memory 111 records programs, data and the like required for operating: the control CPU 110; respective CPUs such as the printer control portion 158 in the image forming apparatus 10; the processing portion; and the control portion, and is used as an example of a non-transient computer-readable recording medium storing programs to be executed by the image forming apparatus 10. Accordingly, the program memory 111 has such programs permanently stored therein. Note that the non-transient computer-readable recording medium storing programs to be executed by the image forming apparatus 10 is not limited to the program memory 111, and may be a recording medium such as a CD-ROM or a DVD-ROM.

The control CPU 110 may perform output settings, operational instructions or the like for a job through the operation portion 140.

Furthermore, the control CPU 110 creates a case binding image list having allocated images of respective pages to predetermined positions of sheets so that pages continue when being spread in order to obtain the booklet 50 of sheets that are center-folded in the relay device 20 and perfect-bound in the post-processing device 30. A case binding image list has defined therein a printing order in which images of pages are to be formed on the sheets so that the sheets in the booklet 50 case-bound by the post-processing device 30 are arranged in the page order. Then, the control CPU 110 generates, for sheets each having a size twice the size specified as each of sheets on which images of the book body are to be formed, a case binding image list for performing the perfect-binding imposition of images of the pages on the sheets so that the scores provided on the sheets lie on the external surface of the center-folded sheets. The image forming portion 151 forms images on the sheet according to the case binding image list. Imposition is a technique of image forming by arranging images of a plurality of pages on a single sheet. Details of the image imposition processing by the control CPU 110 will be described below.

The scanner portion 130 includes the CCD 131 which performs optical reading, and a scanner control portion 132 which controls the entire scanner portion 130. The scanner control portion 132 is connected to the control CPU 110 so as to allow serial communication therebetween. In addition, the CCD 131 is connected to a read processing portion 116 which processes image data read by the CCD 131, and the read processing portion 116 is controllably connected to the DRAM control IC 115.

The read processing portion 116 performs a variety of processing such as analog signal processing, A/D (Analog to Digital) conversion processing, or shading processing on an analog image signal input from the CCD 131, generates digital image data, and outputs the data to an compression/expansion IC 124.

In addition, an ADF control portion 136 is controllably connected to the control CPU 110; the auto document feeder 135 is controlled by ADF control portion 136.

The scanner portion 130 reads images of a document placed on the platen glass 137 of the image forming apparatus 10 or a document automatically conveyed by the auto document feeder 135.

The operation portion 140 includes the LCD 141 and an operation portion control portion 142 which controls the entire operation portion, and the operation portion control portion 142 is connected to the control CPU 110 so as to allow serial communication therebetween.

Under the control of the control CPU 110, the operation portion 140, with the help of the LCD 141, is capable of: inputting device settings such as output condition settings or operation control conditions in the image forming apparatus 10; inputting settings of sheet information (size, sheet type) for respective sheet feed trays; performing settings such that a predetermined post-processing output may be obtained by addition of an offline work; displaying the content of settings; or displaying desired information or the like such as messages.

A compression/expansion IC 124 capable of compressing or expanding image data is connected to the DRAM control IC 115. The DRAM control IC 115 controls compression processing of image data by the compression/expansion IC 124 and expansion processing of compressed image data according to an instruction from the control CPU 110, and also performs input/output control of image data to/from the image memory 120. The control CPU 110 is capable of creating the image data subjected to imposition processing as a case binding image list and storing the case binding image list in the image memory 120.

The write processing portion 125 is connected to the image forming portion 151 including the LD 153 or the like as illustrated *in FIG. 2, and generates write data to be used for operating the LD 153 on the basis of the image data.

The printer portion 150 includes the printer control portion 158 which controls the entire operation (sheet feed, image forming, etc.) of the printer portion 150, the printer control portion 158 being connected to the control CPU 110 to thereby allow serial communication therebetween. The printer control portion 158 operates according to a control instruction of the control CPU 110, controls the printer portion 150 to thereby perform sheet conveyance, image formation, or the like. In addition, the printer control portion 158 is capable of instructing the compression/expansion IC 124 to compress or expand compressed image data.

Furthermore, a relay processing control portion 171 which controls the processing (relay processing) by respective portions in the relay device 20 is controllably connected to the printer control portion 158. The printer control portion 158 is capable of instructing the relay processing control portion 171 to perform relay processing on the basis of an instruction from the control CPU 110, and also capable of acquiring status information in the relay device 20 from the relay processing control portion 171.

Moreover, a post-processing control portion 181 which controls the processing (post-processing) by respective portions in the post-processing device 30 is controllably connected to the printer control portion 158. The printer control portion 158 is capable of instructing the post-processing control portion 181 to perform post-processing on the basis of an instruction from the control CPU 110, and also capable of acquiring status information in the post-processing device 30 from the post-processing control portion 181.

In addition, a DRAM control IC 161 of the print controller 160 is connected to the PCI bus 114 having the DRAM control IC 115 connected thereto. In a case where the image forming apparatus 10 is used as a network printer or a network scanner, the print controller 160 receives image data or the like by using the image forming apparatus 10 from the external device 60 or the like connected to the LAN 2, or transmits image data acquired in the scanner portion 130 to the external device 60 or the like such as a terminal PC connected to the LAN 2.

In the print controller 160, an image memory 162 constituted of a DRAM or the like is connected to the DRAM control IC 161. Additionally, in the print controller 160, the DRAM: control IC 161, a controller control CPU 163 which controls the entire print controller 160, and a LAN interface 165 are connected to a common bus. The LAN interface 165 is connected to the LAN 2.

Furthermore, an IO portion 118 is connected to the control CPU 110. The IO portion 118 operates as an interface for exchanging information between respective portions in the image forming apparatus 10 and the control CPU 110.

The external device 60 has a terminal display portion 61 which performs display and a terminal operation portion 62 which receives operations. The terminal display portion 61 is capable of functioning as a display portion in the present invention, and the terminal operation portion 62 is capable of functioning as an operation portion in the present invention.

The external device 60 may be configured to allow input of operation relating to the image forming apparatus 10 on the terminal operation portion 62 via a VNC (Virtual Network Computing) client or the like, or allow display relating to the image forming apparatus on the terminal display portion 61. Although the terminal operation portion 62 and the terminal display portion 61 may be constituted of, for example, a touch panel without being limited thereto, and may be separately constituted by a operation portion such as an LCD or a mouse, and a display portion such as a display.

Next, the basic operation of the image forming apparatus 10 will be described.

First, a procedure for accumulating image data in the image forming apparatus 10 will be described.

The scanner portion 130 optically reads an image from a document by the CCD 131 to thereby generate image data. At this time, operation control of the CCD 131 is performed by the scanner control portion 132 which receives an instruction from the control CPU 110. Reading of a document may be performed while automatically feeding the document by the auto document feeder 135, or may be performed with the document placed on the platen glass 137.

The control CPU 110 operates by a program, and issues instructions to the scanner portion 130 on the basis of operations (read instruction or copy instruction) by the operation portion 140. The image read by the CCD 131 is subjected to data processing in the read processing portion 116, and the image data subjected to data processing is sent to the compression/expansion IC 124 via the DRAM control IC 115, and compressed by a predetermined method. The compressed data is stored in the image memory 120 via the DRAM control IC 115. When the compressed data stored in the image memory 120 is stored in the HDD 123, the data temporarily stored in the compressed memory 121 is sent to the HDD 123 via the DRAM control IC 115.

Besides this, the image data may be input to the image forming apparatus 10 via the LAN 2. Print data or the like obtained by expanding a print file created by an application programs or the like in the external device 60, for example, is included as image data. The creation method of image data is not limited in particular.

The image data input from the external device 60 or the like via the LAN 2 is received by the print controller 160 via the LAN interface 165, and print data developed by the controller control CPU 163 is temporarily stored in the image memory 162 by the DRAM control IC 161. The data stored in the image memory 162 is transferred to the DRAM control IC 115 via the PCI bus 114 and temporarily stored in the expanded memory 122. The data stored in the expanded memory 122 is sent via the DRAM control IC 115 to the compression/expansion IC 124 and is subjected to compression processing, and is stored in the compressed memory 121 via the DRAM control IC 115. In the case where the compressed data stored in the compressed memory 121 is to be stored in the HDD 123, the data temporarily stored in the compressed memory 121 is sent to the HDD 123 via the DRAM control IC 115.

In accumulation of image data, an output setting is performed before or after accumulating the image data. The output setting can be performed on the basis of the operator's input operation, with a setting screen being displayed on the operation portion 140. In addition, in a case where output setting items have been selected in an initial setting and no setting input is performed by the operator, an output setting is performed on the basis of an initial setting. Furthermore, the operator can perform a post-processing setting on the setting screen.

In a case where the image forming apparatus 10 performs image output, namely, the image forming apparatus 10 is used as a copier or a printer, the image data stored in the compressed memory 121 is sent to the compression/expansion IC 124 via the DRAM control IC 115 and the data is expanded, the expanded data is sent to the write processing portion 125 and the LD 153 performs writing to the photoreceptor drum 154 which has been electrically charged by a charging portion. Note that, in a case where image data stored in the HDD 123 is used, the image data stored in the HDD 123 is temporarily stored in the compressed memory 121 via the DRAM control IC 115, and the image data stored in the compressed memory 121 is sent via the DRAM control IC 115 to the compression/expansion IC 124 and the data is expanded, and the expanded data is sent to the write processing portion 125 in the same way as that described above.

In the printer portion 150, control of respective portions is performed by the printer control portion 158 in response to an instruction from the control CPU 110. In the image forming portion 151, the latent image written to the photoreceptor drum 154 is developed by the developing device 155 (FIG. 2) as a toner image, and the toner image is transferred by the transfer portion 156 (FIG. 2) to a sheet supplied through the conveyance path 13 and is fixed by the fixing device 157. After the toner image is transferred to the sheet, toner remaining on the photoreceptor drum 154 is removed by the cleaning portion. Such formation of an image on a sheet by the image forming portion 151 through control by the printer control portion 158 is also referred to as "perform printing".

Note that, although the present exemplary embodiment has been described assuming monochromatic image forming, the image forming apparatus may also be provided with photoreceptors or the like for respective colors (e.g., cyan, magenta, yellow, black).

The sheet having an image formed thereon is sent to the post-processing device 30 via the conveyance paths 13 and 22 illustrated in FIG. 1, and predetermined post-processing is performed by the post-processing device 30 according to a post-processing setting. Furthermore, in a case where post-processing is not performed, the sheet is directly ejected from the post-processing device 30.

Next, an example of an image transferred to a sheet by the photoreceptor drum 154 will be described referring to FIGS. 4A, 4B, 5A and 5B. Each of the images described in FIGS. 4A, 4B, 5A and 5B is a part of the case binding image list illustrated in the following FIGS. 10A to 10C.

FIGS. 4A and 4B are explanatory diagrams illustrating examples of images being transferred to a sheet having a size twice the size of the book body by the photoreceptor drum 154. Here, a sheet having a size twice the size specified as the sheet on which the book body is to be printed is referred to as a "sheet having a size twice the size of the book body".

Figure 10A:
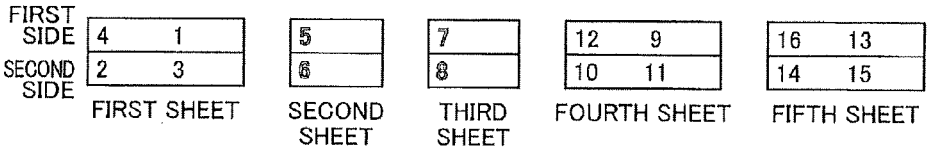
FIG. 10A is an explanatory diagram illustrating an imposition layout example in which pages 5 to 8 are prohibited.

As illustrated in FIG. 4A, toner images (referred to as "under-drum images") formed on the photoreceptor drum 154 are transferred to a first side of the sheet. The first side of the sheet has toner images transferred in order of the fourth page and the first page, as illustrated in FIG. 10A described below. After the image transferred to the first side of the sheet is fixed to the sheet by the fixing device 157, the sheet is reversed.

As illustrated in FIG. 4B, the toner images formed on the photoreceptor drum 154 are transferred to a second side of the reversed sheet. The second side of the sheet has toner images transferred thereto in order of the second page and the third page. Images of the fourth page and the first page illustrated in FIG. 4A are fixed to the lower side of the sheet. After the images transferred to the second side of the sheet are fixed to the sheet by the fixing device 157, the sheet is conveyed to the relay device 20. As illustrated in FIGS. 4A and 4B, allocation of images on both sides of the sheet so that pages are arranged in the correct order when the sheets having toner images transferred thereto are center-folded and subjected to perfect-binding is referred to as "perfect-binding imposition".

FIGS. 5A and 5B are explanatory diagrams illustrating examples of images being transferred to a sheet having the same size as the book body, by the photoreceptor drum 154. Here, a sheet having the same size as the size specified as the sheet on which the book body is to be printed is referred to as a "sheet having the same size as the book body".

As illustrated in FIG. 5A, a toner image formed on the photoreceptor drum 154 is transferred to the first side of the sheet. The first side of the sheet has an image of the fifth page transferred thereto. After the image transferred to the first side of the sheet is fixed to the sheet by the fixing device 157, the sheet is reversed.

As illustrated in FIG. 5B, the toner image formed on the photoreceptor drum 154 is transferred to the second side of the reversed sheet. The second side of the sheet has an image of the sixth page transferred thereto. After the image transferred to the second side of the sheet is fixed to the sheet by the fixing device 157, the sheet is conveyed to the relay device 20. As illustrated in FIGS. 5A and 5B, allocation of a single image to a single page on both sides or one side of the sheet having the same size as the size specified as the sheet on which the images of the book body are to be formed is referred to as "1-in-1 imposition".

In the present exemplary embodiment, an "N-in-1" setting is adopted as a print setting that arranges N images (documents) on a single of sheet. In a case where, for example, a user specifies a normal setting with a magnification of 100% relative to the entire document, a single image is arranged on a single sheet on the basis of a "1-in-1" setting. On the other hand, when a user specifies a setting with a magnification of 50% relative to the entire document, two images are arranged on a single sheet on the basis of a "2-in-1" setting. However, the "2-in-1" setting in the present exemplary embodiment intends that an image with a magnification of 100% relative to the entire document is arranged on a sheet having a size twice the size of the book body. In addition, the "N-in-1" setting is also applied when images having different sizes are arranged on a sheet. For example, a "3-in-1" setting is a setting applied to a glue-on cover sheet illustrated in FIG. 12B described below. With the "3-in-1" setting, the glue-on cover sheet, formed by a sheet of a size determined by adding the spine width corresponding to the thickness of the sheet bundle of the book body to the size twice the size of the book body, has three images arranged on the regions corresponding to the front cover, the back cover, and the spine.

FIG. 6 is an explanatory diagram illustrating a correspondence example of scoring directions and under-drum images.

When the under-drum images to be transferred to the first side of the sheet are arranged in order of page 4 and page 1, and the under-drum images to be transferred to the second side of the sheet are arranged in order of page 2 and page 3, the second scoring portion 23*b* performs scoring on the sheet leftwards (right-hand side of the sheet in the conveyance path 22*b* of FIG. 1). Subsequently, the sheet is conveyed to the folding portion 25 and the sheet is center-folded along the score.

On the other hand, when the under-drum images to be transferred to the first side of the sheet are arranged in order of page 2 and page 3, and the under-drum images to be transferred to the second side of the sheet are arranged in order of page 4 and page 1, the first scoring portion 23*a* performs scoring on the sheet rightwards (left-hand surface of the sheet in the conveyance path 22*b* of FIG. 1). In order that the folding portion 25 may center-fold the sheet so that the scored sides are the external surfaces of the center-folded sheets, reversing processing of the sheet by the pre-folding reversing portion 24 is required.

Figure 7A:
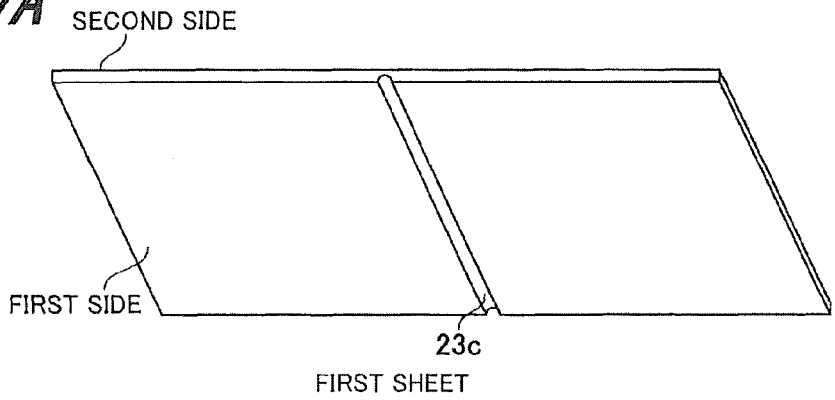
FIG. 7A is an explanatory diagram illustrating an example of a sheet with the scored side facing down.
Figure 7B:
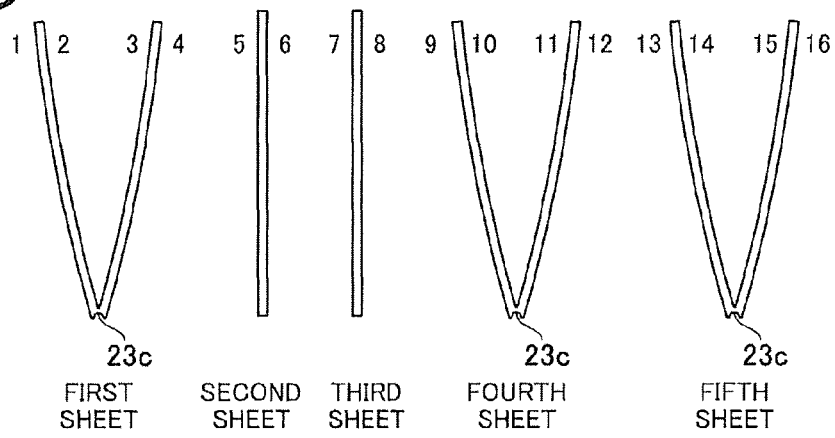
FIG. 7B is an explanatory diagram illustrating an example in which page numbers 1 to 16 are attached to sheets.
Figure 7C:
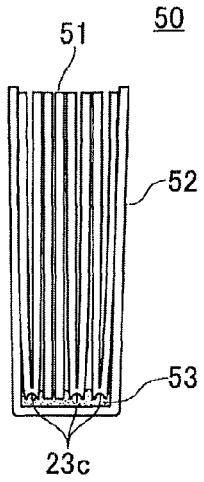
FIG. 7C is an explanatory diagram illustrating an example of a booklet including a sheet bundle case-bound by the bookbinding portion.

FIGS. 7A to 7C are explanatory diagrams illustrating examples of a scored sheet, center-folded sheets, and the case-bound booklet 50.

FIG. 7A illustrates an example of a sheet with the scored side facing down. When the scoring direction is a left direction as illustrated in FIG. 6, the scored side is the first side and the back side of the scored side is the second side. The first side of the sheet has a score 23*c* thereon.

FIG. 7B illustrates an example in which page numbers 1 to 16 are attached to sheets. The folding portion 25 (FIG. 1) center-folds the sheets so that the scored sides are the external surfaces of the center-folded sheets. When images are imposed on the sheet as illustrated in FIG. 10A described below, the first sheet having images of pages 1 to 4 formed thereon, the fourth sheet having images of pages 9 to 12 formed thereon, and the fifth sheet having images of pages 13 to 16 formed thereon are respectively center-folded. Note that each of the sheet sizes of the second sheet having images of pages 5 and 6 formed thereon and the third sheet having images of pages 7 and 8 formed thereon is the same as the size of the book body, and thus the second and the third sheets are not center-folded by the folding portion 25.

FIG. 7C illustrates an example of a sheet bundle 51 of sheets stacked on the book-body stacking portion 32, and the booklet 50 obtained by performing case binding of the sheet bundle 51 by using a glue-on cover 52 by the case binding portion 33. Paste 53 applied to the spine region of the glue-on cover 52 penetrates into the scores 23*c* of respective sheets center-folded so that the scored side is the external surface of the center-folded sheets. Accordingly, the sheet bundle 51 and the spine region of the glue-on cover 52 are caused to strongly adhere to each other.

Figure 8:
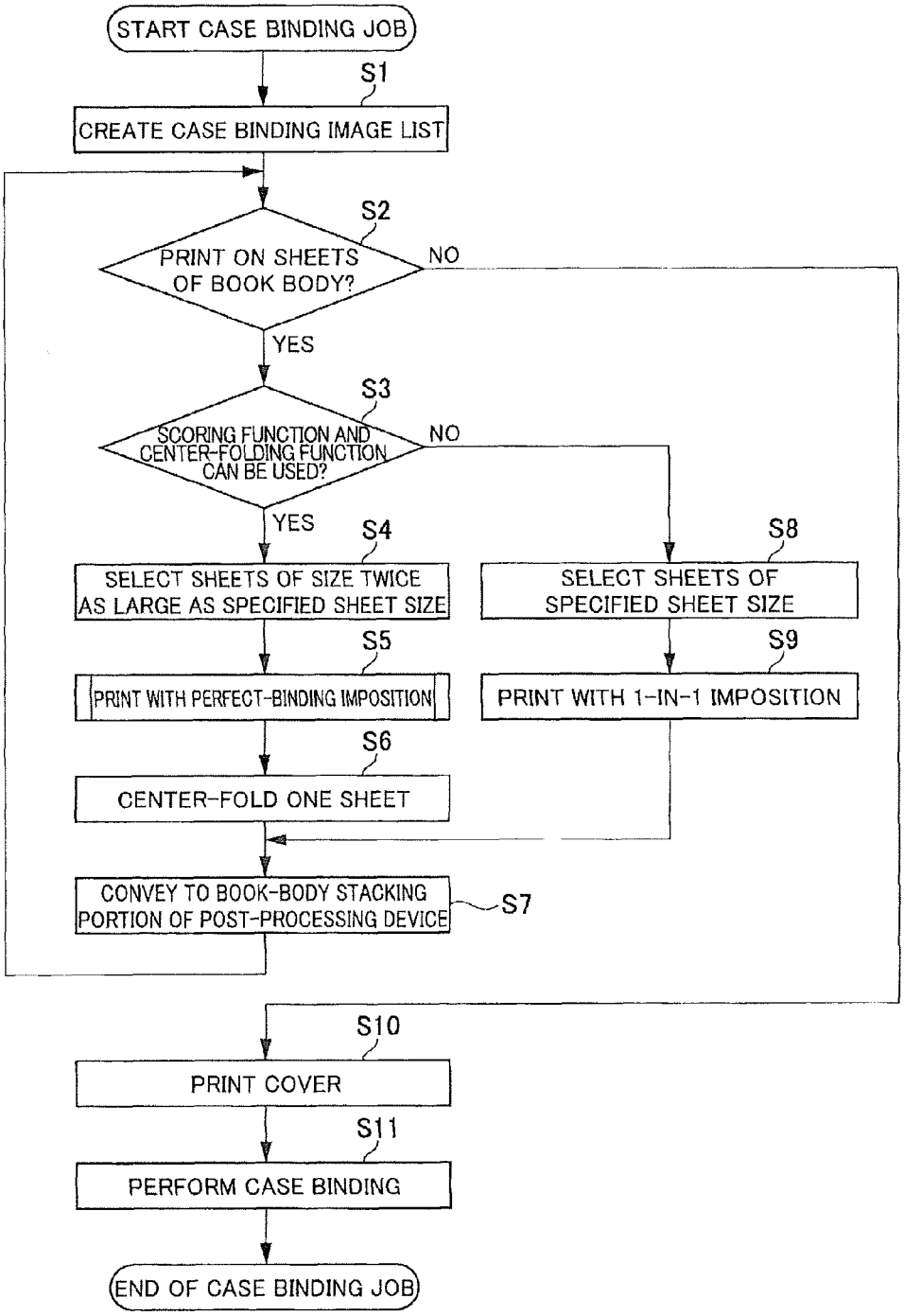
FIG. 8 is a flowchart illustrating an operation example of an image forming system according to an embodiment of the present invention.

FIG. 8 is a flowchart illustrating an operation example of the image forming system 1.

When the image forming apparatus 10 receives a case binding job from the print controller 160, the control CPU 110 creates a case binding image list (S1). At this time, the control CPU 110 determines the sequence of printing images on sheets so that scoring is performed by the scoring portion 23 on a position corresponding to a surface on the spine side of the glue-on cover.

A case binding image list is a set of data defining imposition layouts of images to be imposed on sheets so that sheets of the case-bound booklet 50 are arranged in order of pages, as illustrated in FIGS. 10A to 10C, FIGS. 11A to 11C, and FIGS. 12A and 12B described below. In the present exemplary embodiment, although it is assumed that the control CPU 110 creates case binding image list, the controller control CPU 163 of the print controller 160, or the external device 60 may create the case binding image list.

After step S1, the control CPU 110 determines whether or not to print the sheets of the book body (S2). When the sheets of the book body are to be printed (YES at S2), the control CPU 110 determines whether or not the scoring function of the scoring portion 23 forming a score on a sheet specified for the book body and the center-folding function of the folding portion 25 folding the center of the sheet are both available (S3). Being capable of using the scoring function and the center-folding function indicates that the sheets are not prohibited, whereas not being capable of using the scoring function and the center-folding function indicates that the sheets are prohibited. Note that the size of the sheet specified as the book body is referred to as "specified sheet size".

when it is determined that the scoring function and the center-folding function can be used (YES at S3), the control CPU 110 selects sheets having a size twice the size of the book body (specified sheet size) (S4), and feeds the sheets from the sheet feed tray 12 or the large-capacity sheet feed unit 40.

Then, the image forming portion 151 performs printing of the images of the book body on the fed sheet by using the perfect-binding imposition, in accordance with the case binding image list created by the control CPU 110 (S5). The processing of performing printing on the sheet by using the perfect-binding imposition by the image forming portion 151 controlled by the printer control portion 158 will be explained in FIG. 9 described below. After step S5, the sheets are conveyed to the relay device 20 and center-folded one by one by the folding portion 25 (S6).

On the other hand, when it is determining at step S3 that either the scoring function or the center-folding function cannot be used (NO at S3), the control CPU 110 selects sheets having the same size as the book body (specified sheet size) (S8), and feeds the sheets from the sheet feed trays 12 or the large-capacity sheet feed unit 40. Then, the image forming portion 151 performs printing of the images of the book body on the fed sheets by using the 1-in-1 imposition, in accordance with the case binding image list created by the control CPU 110 (S9).

The sheets printed according to the perfect-binding imposition and center-folded at step S6, or the sheets printed by using the 1-in-1 imposition at step S9 are conveyed to the book-body stacking portion 32 of the post-processing device 30 (S7), and the sheets are stacked on the book-body stacking portion 32. Subsequently, the control CPU 110 returns to step S2, and repeats the processes of steps S2 to S7 as long as printing on the sheets of the book body continues.

Then, when it is determined at step S2 that printing is not performed on sheets of the book body (NO at S2), the control CPU 110 feeds the glue-on cover 52 from the sheet feed trays 12 or the large-capacity sheet feed unit 40, and the image forming portion 151 performs printing of the cover image on the fed sheet (S10). Subsequently, after the scoring portion 23 has performed scoring on the glue-on cover 52, the case binding portion 33 performs case binding (S11), and the booklet 50 is ejected from the ejection portion 34.

Figure 9:
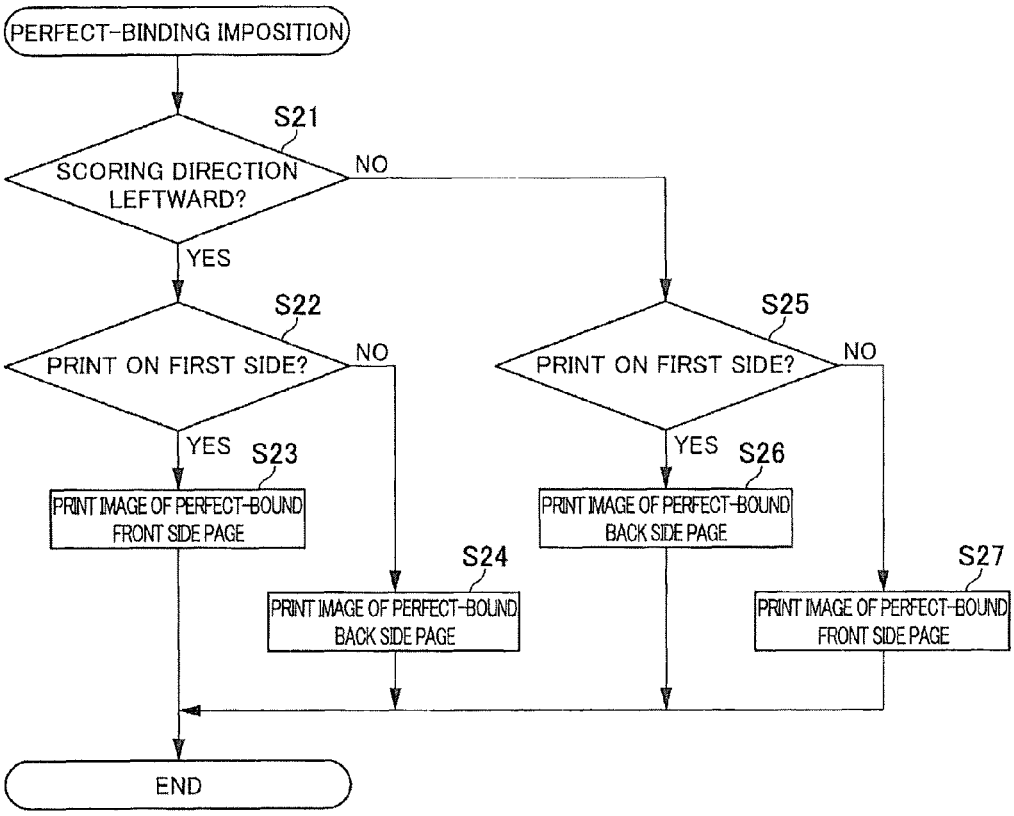
FIG. 9 is a flowchart illustrating a processing example of the perfect-binding imposition at step S5 of FIG. 8.

FIG. 9 is a flowchart illustrating a processing example of the perfect-binding imposition at step S5 of FIG. 8.

First, the printer control portion 158 determines whether or not the direction of scoring performed on the sheets of the book body by the scoring portion 23 is a left direction (S21). The printer control portion 158 can determine from which direction the scoring portion 23 performs scoring on the sheet by, for example, acquiring information of the scoring direction from the relay processing control portion 171. Then, the printer control portion 158 changes the order of forming images on the sheet so that the position of the score to be formed by the scoring portion 23 is set to a position corresponding to a surface on the side of the spine of the glue-on cover. Here, when the scoring direction is a left direction (YES at S21), the printer control portion 158 determines whether or not to perform printing on the first side (S22).

When printing is to be performed on the first side (YES at S22), the image forming portion 151 prints the image of the perfect-bound front side page (e.g., pages 4 and 1 illustrated in FIG. 6) on the sheet (S23). When printing is to be performed on the second side (NO at S22), the image forming portion 151 prints the image of the perfect-bound back side page (e.g., pages 2 and 3 illustrated in FIG. 6) on the sheet (S24).

When the scoring direction is a right direction at step S21 (NO at S21), the printer control portion 158 determines whether or not to perform printing on the first side (S25).

When printing is to be performed on the first side (YES at S25), the image forming portion 151 prints the image of the perfect-bound back side page (e.g., pages 2 and 3 illustrated in FIG. 6) on the sheet (S26). When printing is to be performed on the second side (NO at S25), the image forming portion 151 prints the image of the perfect-bound front surface page (e.g., pages 4 and 1 illustrated in FIG. 6) on the sheet (S27).

Note that, although the determination processing illustrated in FIG. 9 is performed by the printer control portion 158, the processing may also be performed by the control CPU 110.

FIGS. 10A to 10C, FIGS. 11A to 11C, and FIGS. 12A and 12B illustrate an imposition layout example of images imposed on sheets. In the following description, designation of printing, on a sheet, images imposed on both sides of the sheet is referred to as "duplex printing designation". Furthermore, designation of printing, on a sheet, images imposed on only one side of the sheet is referred to as "simplex printing designation". Duplex printing designation and simplex printing designation are designated by the external device 60 or the print controller 160.

Figure 10B:
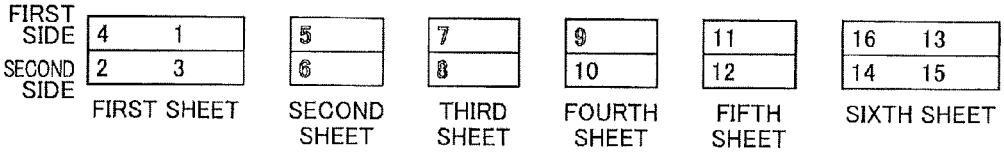
FIG. 10B is an explanatory diagram illustrating a first imposition layout example in which pages 5 to 9 are prohibited.
Figure 10C:
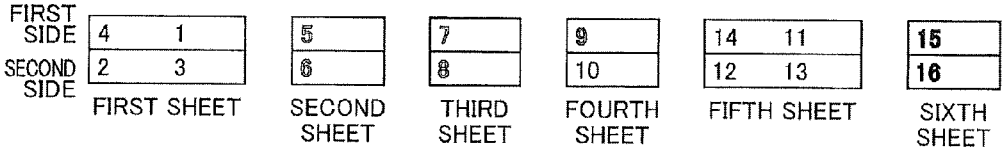
FIG. 10C is an explanatory diagram illustrating a second imposition layout example in which pages 5 to 9 are prohibited.

FIGS. 10A to 10C are explanatory diagrams illustrating imposition layout examples of images imposed on an ordinary sheet and a sheet which is prohibited.

FIG. 10A illustrates an imposition layout example in which pages 5 to 8 are prohibited. For example, the scoring portion 23 cannot form a score on a special sheet (glossy sheet, or the like) or the folding portion 25 cannot center-fold the special sheet (glossy sheet, or the like). In the present exemplary embodiment, a sheet on which the scoring portion 23 cannot form a score or a sheet the folding portion 25 cannot center-fold is referred to as a prohibited sheet. Whether or not a sheet is prohibited is determined by sheet type, sheet weight, or the like. Furthermore, when partial pages of a plurality of pages are prohibited, the sheet on which images of prohibited pages are to be printed cannot be subjected to scoring and center-folding. Then, when the booklet 50 includes prohibited sheets, the control CPU 110 creates a case binding image list for performing the 1-in-1 imposition of the images on the sheet and conveys, to the book-body stacking portion 32, the sheet having images formed thereon by the image forming portion 151 by using the 1-in-1 imposition, without being subjected to the processing by the scoring portion 23 and the folding portion 25.

Here, as illustrated in FIG. 10A, the prohibited sheet having images of pages 5 to 8 printed thereon is not subjected to scoring by the scoring portion 23 and center-folding by the folding portion 25, and thus pages 5 to 8 is to be prohibited. Accordingly, the first sheet has printed thereon the perfect-binding-imposed images of pages 1 to 4, whereas the second sheet has printed thereon the 1-in-1-imposed images of pages 5 and 6, and the third sheet has printed thereon the 1-in-1-imposed images of pages 7 and 8. Then, the fourth sheet has the perfect-binding-imposed images of pages 9 to 12 printed thereon, and the fifth sheet has printed thereon the perfect-binding-imposed images of pages 13 to 16.

FIG. 10B illustrates a first imposition layout example in which pages 5 to 9 are prohibited. In the first imposition layout example, the images to be perfect-binding-imposed or 1-in-1-imposed on the first to the third sheets are the same as those illustrated in FIG. 10A. However, page 9 is also prohibited and thus the fourth sheet has printed thereon the 1-in-1-imposed images of pages 9 and 10. Furthermore, the fifth sheet has the 1-in-1-imposed images of pages 11 and 12 printed thereon in accordance with the 1-in-1-imposed fourth sheet. Then, the sixth sheet has printed thereon the perfect-binding-imposed images of pages 13 to 16.

FIG. 10C illustrates a second imposition layout example in the case where pages 5 to 9 are prohibited. In the second imposition layout example, the images to be perfect-binding-imposed or 1-in-1-imposed on the first to the fourth sheets are the same as those illustrated in FIG. 10B. However, the fifth sheet has printed thereon the perfect-binding-imposed images of pages 11 to 14. Then, the sixth sheet will have the 1-in-1-imposed images of pages 15 and 16 printed thereon in accordance with the 1-in-1-imposed fourth sheet. When the images of pages 11 to 14 are subjected to the perfect-binding imposition as thus described, pages 15 and 16 are left as leftovers and thus the images of pages 15 and 16 are subjected to the 1-in-1 imposition.

FIGS. 11A to 11C are explanatory diagrams illustrating imposition layout examples of images imposed on sheets including simplex printing designation.

FIG. 11A illustrates an imposition layout example in the case where simplex printing is specified for pages 5 and 6. The first sheet has printed thereon the perfect-binding-imposed images of pages 1 to 4. However, the second sheet has, in addition to the image of pages 5 and 6, blank images corresponding to respective pages are subjected to the perfect-binding imposition and are printed thereon. In addition, the third sheet has printed thereon the perfect-binding-imposed images of pages 7 to 10. In a case where simplex printing is specified for pages 5 and 6 as thus described, only the images of pages which are on the front side and the back side when being center-folded by the folding portion 25 are printed on the sheet, and blank images are added to pages which are not provided with page numbers. Note that, although the pages with blank images added thereto have no image to be printed thereon by the image forming portion 151, an image otherwise prepared may be used as the blank image.

FIG. 11B illustrates an imposition layout example in a case where simplex printing is specified for only the image of page 5. The control CPU 110 creates a case binding image list for performing the perfect-binding imposition with blank images added to the images of the book body in a case where there is designated simplex printing in which the image forming portion 151 forms the images of the book body on only one side of the sheets and there is also designated simplex printing for the next page. In such a case, simplex printing is designated for the second sheet, the 1-in-1-imposed image of page 5 is printed on the first side, simplex printing is designated for the third sheet, and the 1-in-1-imposed image of page 6 is printed on the first side. In addition, the fourth sheet has printed thereon the perfect-binding-imposed images of pages 7 to 10. Although simplex printing is designated for only the image of page 5 in FIG. 11B, simplex printing will be s designated for the image of page 6 which is leftover. Accordingly, the image of pages 5 and 6 is imposed on only one side (first side) of two sheets.

FIG. 11C illustrates an imposition layout example in a case where simplex printing is designated for the image of page 5, whereas duplex printing is designated for the images of pages 6 and 7. In a case where there is designated simplex printing in which the image forming portion 151 forms the images of the book body on only one side of the sheets, and there is designated duplex printing for the next page in which the image forming portion 151 forms the images of the book body on both sides of the sheets, the control CPU 110 selects the sheets each having the same size as the size specified as each of the sheets on which the images of the book body are to be formed, and creates a case binding image list for performing the 1-in-1 imposition of the images of the book body on both sides of the sheets. In such a case, simplex printing is designated for the second sheet, the 1-in-1-imposed image of page 5 is printed on the first side, duplex printing is designated on the third sheet, and the 1-in-1-imposed images of pages 6 and 7 are printed on both sides of sheet. Then, the fourth sheet has printed thereon the perfect-binding-imposed images of pages 8 to 10 and the added blank images.

FIGS. 12A and 12B are explanatory diagrams illustrating imposition layout examples of images imposed on sheets including the glue-on cover.

In case binding, the image forming portion 151 forms an image on not only the glue-on cover inserted from the PI portion 21 but also on a sheet fed from the sheet feed trays 12 or the large-capacity sheet feed unit 40; and the sheet can be used as a glue-on cover. In a case where the image forming portion 151 forms the images on the glue-on cover, the control CPU 110 creates the image list for performing the perfect-binding imposition of remaining images, on the sheets, except for the images formed on the glue-on cover, and for adding blank images to leftover pages and performing the perfect-binding imposition thereon.

FIG. 12A illustrates an imposition layout example in a case where simplex printing is designated for images arranged on the glue-on cover in accordance with the "2-in-1" setting. In the present example, page 1 has the image of the front cover and page 16 has the image of the back cover. The first side of the first sheet being the glue-on cover has printed thereon images of pages 1 and 16 for which simplex printing is designated. The second sheet has perfect-binding-imposed images of pages 2 to 5 printed thereon, the third sheet has printed thereon the perfect-binding-imposed images of pages 6 to 9, and the fourth sheet has printed thereon the perfect-binding-imposed images of pages 10 to 13. In addition, the fifth sheet is subjected to the perfect-binding imposition and printing so that a blank image and an image of page 14 are arranged on the first side thereof, and the image of page 15 and a blank image are arranged on the second side thereof.

FIG. 12B illustrates an imposition layout example in a case where duplex printing is designated for images arranged on the glue-on cover in accordance with the "3-in-1" setting. In the present example, page 1, page 15, and page 16 respectively have the images of the front cover, the back cover, and the spine. The first side of the first sheet being the glue-on cover has arranged and printed thereon the images of pages 15, 16, and 1 for which duplex printing is designated, and the second side has arranged and printed thereon the images of pages 2 and 14 which are respectively the end leaves of the front cover and the back cover. The second sheet has printed thereon the perfect-binding-imposed images of pages 3 to 6, and the third sheet has printed thereon the perfect-binding-imposed images of pages 7 to 10. In addition, the fourth sheet is subjected to the perfect-binding imposition and printing so that a blank image and an image of page 11 are arranged on the first side thereof, and the images of pages 12 and 13 are arranged on the second side thereof.

In the image forming system 1 according to an embodiment described above, the sheets of the book body having printed thereon perfect-binding-imposed images of respective pages are subjected to scoring one by one, and are subjected to center-folding so that the scored side is on the external surface. Then, after the center-folded sheet is accommodated in the book-body stacking portion 32, glue is applied onto the side subjected to scoring by the case binding portion 33 to perform case binding. Accordingly, it becomes easy for the glue to penetrate into the score formed on the sheet. In addition, the glue which has penetrated into the score formed on the center-folded sheet of the book body adheres strongly to the spine region of the glue-on cover, and respective sheets of the sheet bundle are strongly glued inside the glue-on cover, and thus it is possible to perform binding of the booklet 50 without the sheets of the book body falling off from the glue-on cover. Therefore, it is possible to enhance the quality of case binding.

Furthermore, the printer control portion 158 changes the printing order of images to be printed on the first side and the second side of a sheet in accordance with the direction in which the scoring portion 23 performs scoring on the sheet. Accordingly, the sheet is center-folded so that the scored side of the sheet subjected to scoring is on the external surface of the center-folded sheet.

Moreover, when images of respective pages are subjected to the perfect-binding imposition, images of a prohibited page are subjected to the 1-in-1 imposition. Then, images of other pages are also subjected to the 1-in-1 imposition in accordance with the 1-in-1-imposed pages. At this time, images of all the pages are imposed on the sheets by a combination of the 1-in-1 imposition and the perfect-binding imposition. Accordingly, no unnecessary blank pages are generated.

Note that, in a case where 1-in-1-imposed images of the book body are formed on the sheets inserted from the PI portion 21, the control CPU 110 conveys the sheets to the book-body stacking portion 32 without causing processing by the scoring portion 23 and the folding portion 25 to be performed. Furthermore, in a case where the perfect-binding-imposed images of the book body are formed on the sheets inserted from the PI portion 21, the control CPU 110 causes processing by the scoring portion 23 and the folding portion 25 to be performed, and then conveys the sheets to the book-body stacking portion 32. Accordingly, sheets having images formed thereon by another image forming apparatus can also be subjected to case binding.

In addition, although the relay device 20 and the post-processing device 30 are capable of in-line operation together with the image forming apparatus 10, the relay device 20 and the post-processing device 30 may also be arranged so as to be capable of off-line operation.

Furthermore, the imposition processing according to the present exemplary embodiment may be applied to an image forming apparatus capable of CMYK color printing.

Moreover, the scoring portion 23 and the folding portion 25 may be constituted as a single processing portion which performs scoring and center-folding simultaneously.

In addition, the scoring portion 23, the folding portion 25, the book-body stacking portion 32, and the case binding portion 33 may be constituted as a single post-processing device 30.

Furthermore, the present invention is not limited to the aforementioned exemplary embodiment, and it is needless to say that other various application examples and modifications can be employed as long as the gist of the present invention described in claims is not departed.

For example, in the exemplary embodiment described above, the configuration of the apparatus and the system is explained in detail and specifically in order to explain the present invention so as to be easily understood, and is not necessarily limited to the one including all the configurations explained. In addition, apart of a configuration of an exemplary embodiment can be replaced by the configuration of another embodiment, and furthermore, the configuration of another embodiment can be added to the configuration of one exemplary embodiment. Additionally, regarding apart of the configurations of the exemplary embodiments, addition of another configuration, deletion or replacement can also be made.

Furthermore, control lines or information lines considered to be required for explanation are indicated, and not all the control lines or information lines in a product are indicated. Actually, it may be considered that almost all the configurations are connected to each other.

REFERENCE SIGNS LIST

1 image forming system
10 image forming apparatus
20 relay device
21 PI portion
23 scoring portion
24 pre-folding reversing portion
25 folding portion
26 pre-conveyance reversing portion
30 post-processing device
32 book-body stacking portion
33 case binding portion
34 ejection portion
150 printer portion
151 image forming portion

What is claimed is:

1. An image forming apparatus comprising:

an image forming portion configured to form images on sheets, in accordance with an image list defining order of the images of pages to be formed on the sheets of a case-bound booklet so that the sheets are bound in order of the pages; and a control portion configured to create the image list for performing the perfect-binding imposition of the images of the pages on the sheets so that the scores formed on the sheets are on the external surface of the center-folded sheets, for the sheets each having a size twice the size specified as each of the sheets on which the images of the book body are to be formed, in a case where a book-body stacking portion accommodates the sheets center-folded by a folding portion along scores formed for every sheet from a predetermined direction by a scoring portion on one side of each of the sheets having the images formed thereon by the image forming portion, and a bookbinding portion uses a glue-on cover to thereby perform case binding of a bundle of the sheets glued to a side of a spine.

2. The image forming apparatus according to claim 1, wherein the control portion changes order of forming images on the sheet by the image forming portion so that a position of the score to be formed by the scoring portion is set to a position corresponding to the side of the spine of the glue-on cover.

3. The image forming apparatus according to claim 1, wherein, in a case where the image forming portion forms the images on the sheets which cannot be subjected to formation of the score by the scoring portion or subjected to center-folding by the folding portion, the control portion creates the image list for performing the 1-in-1 imposition of the images on the sheets each having a same size as the size specified as each of the sheets on which the images of the book body are to be formed, and conveys, to the book-body stacking portion, the sheets having images formed thereon by using the 1-in-1 imposition, without being subjected to processing by the scoring portion and the folding portion.

4. The image forming apparatus according to claim 3, wherein the control portion creates the image list for performing the perfect-binding imposition with blank images added to the images of the book body, in a case where a page next to a page having simplex printing designated in which the image forming portion forms the images of the book body on only one sides of the sheets also has the simplex printing designated, and selects the sheets each having a size specified as each of the sheets on which the images of the book body are to be formed, and creates the image list for performing the 1-in-1 imposition of the images of the book body on both sides of the sheets in a case where there is designated duplex printing for the next page in which the image forming portion forms the images of the book body on both sides of the sheets.

5. The image forming apparatus according to claim 3 further comprising:

a sheet insertion portion configured to insert the sheets having the images of the book body formed thereon, wherein the control portion conveys the sheets to the book-body stacking portion, without being subjected to processing by the scoring portion and the folding portion in a case where 1-in-1-imposed images of the book body are formed on the sheets inserted from the sheet insertion portion, and causes processing to be performed by the scoring portion and the folding portion and then conveys the sheets to the book-body stacking portion, in a case where the perfect-binding-imposed images of the book body are formed on the sheets inserted from the sheet insertion portion.

6. The image forming apparatus according to claim 1, wherein the control portion creates the image list for performing the perfect-binding imposition of remaining images, on the sheets, except for the images formed on the glue-on cover, and for adding blank images to leftover pages and performing the perfect-binding imposition thereon, in a case where the image forming portion forms the images on the glue-on cover.

7. A computer-readable recording medium storing a program comprising the steps of:

forming images on sheets, by an image forming portion included in an image forming apparatus, in accordance with an image list defining order of the images of pages to be formed on the sheets of a case-bound booklet so that the sheets are bound in order of the pages; and creating, by a control portion, the image list for performing the perfect-binding imposition of the images of the pages on the sheets so that the scores formed on the sheets are on the external surface of the center-folded sheets, for the sheets each having a size twice the size specified as each of the sheets on which the images of the book body are to be formed, in a case where a book-body stacking portion accommodates the sheets center-folded by a folding portion along scores formed for every sheet from a predetermined direction by a scoring portion for each of the sheets having the images formed thereon by the image forming portion, and a bookbinding portion uses a glue-on cover to thereby perform case binding of a bundle of the sheets glued to a side of a spine.

8. The computer-readable recording medium storing a program according to claim 7, wherein the control portion changes order of forming images on the sheet by the image forming portion so that a position of the score to be formed by the scoring portion is set to a position corresponding to the side of the spine of the glue-on cover.

9. The computer-readable recording medium storing a program according to claim 7, wherein in a case where the image forming portion forms the images on the sheets which cannot be subjected to formation of the score by the scoring portion or subjected to center-folding by the folding portion, the control portion creates the image list for performing the 1-in-1 imposition of the images on the sheets each having a same size as the size specified as each of the sheets on which the images of the book body are to be formed, and conveys, to the book-body stacking portion, the sheets having images formed thereon by using the 1-in-1 imposition, without being subjected to processing by the scoring portion and the folding portion.

10. The computer-readable recording medium storing a program according to claim 9, wherein the control portion creates the image list for performing the perfect-binding imposition with blank images added to the images of the book body, in a case where a page next to a page having simplex printing designated in which the image forming portion forms the images of the book body on only one sides of the sheets also has the simplex printing designated, and selects the sheets each having a size specified as each of the sheets on which the images of the book body are to be formed, and creates the image list for performing the 1-in-1 imposition of the images of the book body on both sides of the sheets in a case where there is designated duplex printing for the next page in which the image forming portion forms the images of the book body on both sides of the sheets.

11. The computer-readable recording medium storing a program according to claim 9 further comprising:

a sheet insertion portion configured to insert the sheets having the images of the book body formed thereon, wherein the control portion conveys the sheets to the book-body stacking portion, without being subjected to processing by the scoring portion and the folding portion in a case where 1-in-1-imposed images of the book body are formed on the sheets inserted from the sheet insertion portion, and causes processing to be performed by the scoring portion and the folding portion and then conveys the sheets to the book-body stacking portion, in a case where the perfect-binding-imposed images of the book body are formed on the sheets inserted from the sheet insertion portion.

12. The computer-readable recording medium storing a program according to claim 7, wherein the control portion creates the image list for performing the perfect-binding imposition of remaining images, on the sheets, except for the images formed on the glue-on cover, and for adding blank images to leftover pages and performing the perfect-binding imposition thereon, in a case where the image forming portion forms the images on the glue-on cover.

* * * * *